US007249451B2

(12) United States Patent
Giudici

(10) Patent No.: US 7,249,451 B2
(45) Date of Patent: Jul. 31, 2007

(54) TEXTURING AND INTERLACING MACHINE

(75) Inventor: Domenico Giudici, Lecco (IT)

(73) Assignee: Giudici S.p.A. (IT)

( * ) Notice: Subject to any disclaimer, the term of this patent is extended or adjusted under 35 U.S.C. 154(b) by 298 days.

(21) Appl. No.: 10/489,786

(22) PCT Filed: Nov. 8, 2002

(86) PCT No.: PCT/IT02/00706

§ 371 (c)(1),
(2), (4) Date: Nov. 15, 2004

(87) PCT Pub. No.: WO03/042437

PCT Pub. Date: May 22, 2003

(65) Prior Publication Data

US 2006/0254246 A1 Nov. 16, 2006

(30) Foreign Application Priority Data

Nov. 14, 2001 (IT) ..... MI20010600 U

(51) Int. Cl.
*D02G 3/36* (2006.01)

(52) U.S. Cl. ..... 57/6

(58) Field of Classification Search ..... 57/3, 57/6, 210, 225–228, 243–246
See application file for complete search history.

(56) References Cited

U.S. PATENT DOCUMENTS 3,940,917 A 3/1976 Strachan
4,829,757 A 5/1989 Canton
4,894,894 A * 1/1990 Coons et al. ..... 28/220
5,008,992 A 4/1991 Gehrmann et al.
5,056,200 A * 10/1991 Schwartz et al. ..... 28/258
6,105,224 A 8/2000 O'Mara, Jr. et al.
6,582,816 B2 * 6/2003 Rasnick et al. ..... 428/364
6,880,212 B2 * 4/2005 Bakker et al. ..... 28/271

FOREIGN PATENT DOCUMENTS

EP 0 994 205 4/2000
FR 2 749 859 12/1997

* cited by examiner

*Primary Examiner*—Shaun R. Hurley
(74) *Attorney, Agent, or Firm*—McGlew and Tuttle P.C

(57) ABSTRACT

The machine comprises a texturing zone (12) trough which a covering yarn (22) advances; a feed unit (C) for an elastomer yarn (20); combining means to combine the textured covering yarn (22) with the elastomer yarn (20), said means comprising a first roller (B) to which said textured covering yarn (22) and said elastomer yarn (20) are fed; downstream of said first roller (B) an interlacing device (23) to interlace said textured covering yarn (22) and said elastomer yarn (20). Moreover, a drawing roller (A) for the textured covering yarn (22) is also provided between the texturing zone (12) and said first roller (B) of the combining means.

15 Claims, 1 Drawing Sheet

TEXTURING AND INTERLACING MACHINE

TECHNICAL FIELD

The present invention relates to a machine for texturing yarns, composed as known in the art of a feed section (creel), a texturing treatment section, and a section to take up the textured yarn (collection).

PRIOR ART

The system known in the art combines, downstream of these machines, one or more textured yarns with an elastomer yarn, generally Lycra, which is pre-stretched to impart greater elasticity to the combined yarns. The textured yarn forms a covering or coating around the elastomer yarn. Combination is performed with specific interlacing devices, generally air interlacing devices. An example of air interlacing is described in U.S. Pat. No. 3,940,917.

This process is also integrated with texturing machines to obtain, in a single cycle, the functions of texturing and interlacing. Combined devices to perform in-line texturing of the covering yarn and subsequent combination with the elastomer yarn are described in U.S. Pat. No. 6,393,817 and U.S. Pat. No. 5,008,992. Nonetheless, there are some drawbacks in known embodiments of this type. Firstly, the feed unit for the elastomer yarn is situated in a distant position from the texturing machine, and is thus inconvenient for the operator.

Moreover, the elastomer and textured yarns are fed directly to the interlacing zone. In U.S. Pat. No. 5,008,992 the textured yarn is fed directly into a nip between two feed rollers, into which the elastomer yarn is also fed, coming directly from an unwinder of a package of elastomer. The two yarns are delivered from the feed rollers to the interlacing jet.

OBJECTS AND SUMMARY OF THE INVENTION

The object of the present invention is the production of a combined machine, for texturing of a covering or coating yarn and for interlacing this yarn with an elastomer yarn, which overcomes the drawbacks of machines known in the art.

This and other objects and advantages, which shall appear clear to those skilled in the art from reading the text hereinafter, are attained with a machine comprising: a texturing zone through which a covering yarn advances; a feed unit for an elastomer yarn; combining means to combine the textured covering yarn with the elastomer yarn, which comprises a first roller to which the textured covering yarn and the elastomer yarn are fed; downstream of the first roller an interlacing device for interlacing said textured covering yarn and said elastomer yarn. Characteristically, according to the invention, a drawing roller of the textured covering yarn is disposed between the texturing zone and the first roller of combining means.

Advantageously, the speed ratio between the first roller of the combining means, the drawing roller and/or the feed unit of the elastomer yarn may be variable.

Further advantageous characteristics and embodiments of the invention are indicated in the appended claims.

The invention makes it possible to attain overfeed ratios (possibly also stretch to encourage better return) of the textured yarn and of stretch of the elastomer yarn before they enter the interlacing phase, to allow this phase to be performed in the most advantageous conditions.

This produces an excellent quality of resulting yarn and possibly also a reduction in air consumption in the interlacing device.

The position of the feed device of the elastomer yarn immediately downstream of the drawing roller of the textured yarn is ideal to facilitate threading, that is to say initial introduction of the yarn into the machine.

BRIEF DESCRIPTION OF THE DRAWINGS

The invention shall now be described with reference to the appended drawings in which.

DETAILED DESCRIPTION OF THE PREFERRED EMBODIMENT

Figure 1:
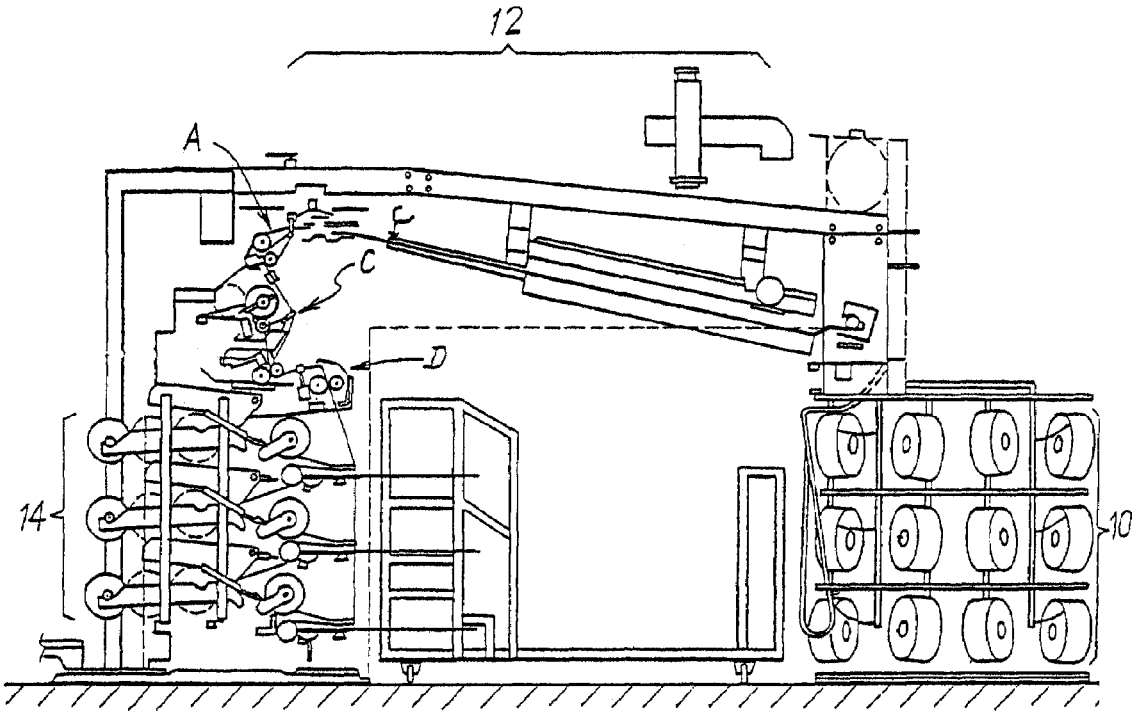
FIG. 1 shows a texturing machine according to the invention.
Figure 2:
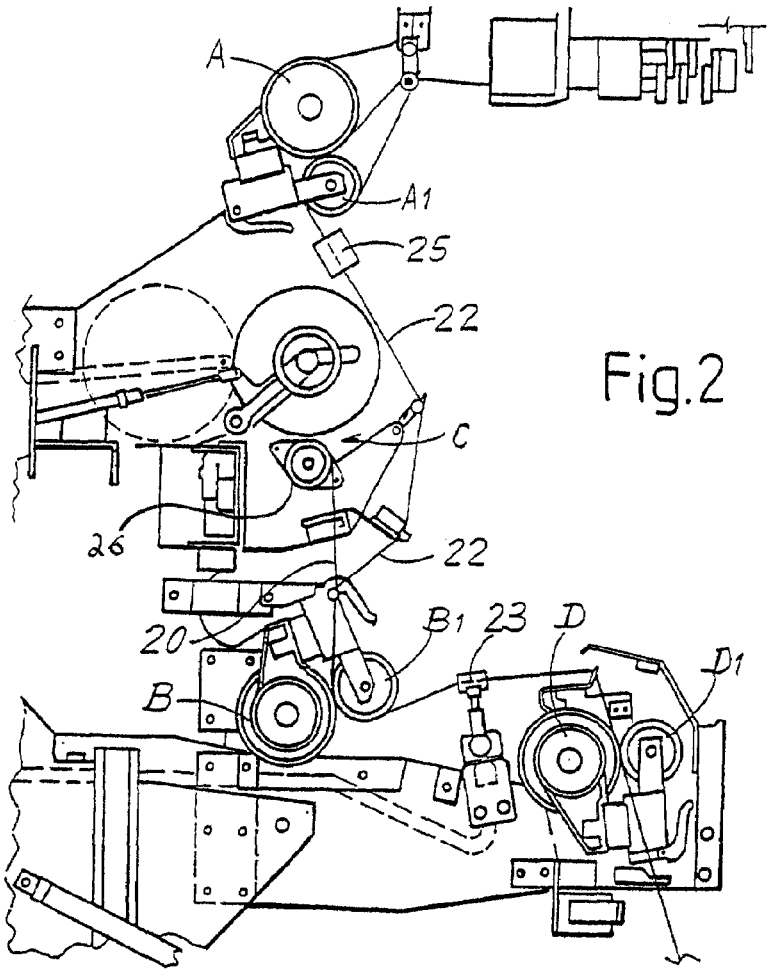
FIG. 2 is an illustration, enlarged in relation to FIG. 1, of the part of the texturing machine dedicated to combining and interlacing the textured yarn with the elastomer yarn.

With reference firstly to FIG. 1, the machine illustrated comprises, as known in the art, a feed zone 10 for the covering yarn 22 to be textured, a texturing zone 12, which terminates with a draw roller A to pick up the textured yarn 22. The roller A cooperates with a counter pressure roller A1. Downstream of the roller A, in a position immediately adjacent to it, is a unit C to feed elastomer yarn 20, for example Lycra (see FIG. 2) which sends this elastomer yarn 20 to another additional or combining roller B which forms part of combining means of the yarns 20 and 22 and to which the textured covering yarn 22 coming from the roller A is simultaneously fed. The combining roller B cooperates with a counter pressure roller B1.

The ratio between the speed of rotation of the rollers A and B may be established as desired so as to allocate the textured covering yarn 22 a stretch or an overfeed chosen at will by the operator to obtain the most favorable conditions. Naturally, it is also possible to obtain a circumferential speed ratio of the rollers A and B of 1, with simple transfer of the yarn.

Likewise, the stretch ratio between the combining roller B and the delivery roller 26 of the feed unit C may be chosen at will, to impart the desired stretch to the elastomer yarn 20, which may differ from the stretch of the textured covering yarn 22.

In this way, the two yarns, textured 22 and elastomer 20, are sent to interlacing device 23 without being subjected to, in this device, stresses of any nature and in particular stretch or overfeed stresses differing from each other. This produces a better quality in the resulting yarn and possibly also a reduction in air consumption in the interlacing device 23. Positioned at the outlet in the interlacing device 23 is a pick up roller D for the composite yarn, formed by interlacing the yarns 20 and 22. The roller D cooperates with a counter pressure roller D1. The roller D is preferably operated at the most appropriate speed of the combining roller B (generally overfeed), in order to obtain the best interlacing conditions.

Downstream of the roller D (FIG. 1) the composite yarn is collected in a section 14 of the machine, according to conventional methods.

It is understood that the drawing only shows one embodiment provided purely as a practical illustration of the invention, as the invention may vary in form and layout without departing from the scope of the concept which forms the invention. The presence of any reference numerals in the appended claims is intended to faclitate reading of the claims with reference to the description and the drawing, and does not limit the scope of protection represented by the claims.

The invention claimed is:

1. Machine for texturing a covering yarn and interlacing said textured covering yarn with an elastomer yarn, comprising:

a texturing zone through which said covering yarn advances;

a feed unit for the elastomer yarn, said feed unit including a delivery roller;

combining means to combine the textured covering yarn with the elastomer yarn, said means comprising a combining roller to which said textured covering yarn and said elastomer yarn are fed;

a drawing roller for the textured covering yarn disposed between said texturing zone and said combining roller of the combining means;

providing downstream of said combing roller an interlacing device to interlace said textured covering yarn and said elastomer yarn, wherein a ratio between a speed of rotation of said drawing roller for the textured covering yarn and a speed of rotation of said combining roller of the combining means can be set at a value different from a ratio between said speed of said combining roller and a speed of said delivery roller of the feed unit.

2. Machine as claimed in claim 1, wherein the ratio between the rotation speed of said combining roller of the combining means and the rotation speed of the drawing roller is variable.

3. Machine as claimed in claim 2, wherein the rotation speed of said combining roller of the combining means can be regulated to vary at will the ratio of the speeds in relation to the drawing roller of the textured covering yarn.

4. Machine as claimed in claim 1, wherein the rotation speed of said combining roller of the combining means can be regulated to vary at will the ratio of the speeds in relation to the drawing roller of the textured covering yarn.

5. Machine as claimed in claim 1, 2 or 4, wherein the ratio of the rotation speeds of said combining roller in the combining means and of the feed unit of the elastomer yarn can be regulated to obtain the desired stretch ratio of the elastomer yarn prior to interlacing.

6. Machine as claimed in any one of claims 1, 2, 4 and 3, wherein positioned downstream of the interlacing device is a pick up roller and wherein the ratio between the speeds of said combining roller of the combining means and the delivery roller can be regulated.

7. Machine as claimed in claim 6, wherein the speed of said combining roller of the combining means is greater than the speed of said pick up roller to obtain an overfeed.

8. Machine as claimed in any one of claims 1, 2, 4 and 3, wherein the feed unit of the elastomer yarn is disposed immediately adjacent to and downstream of the drawing roller of the textured covering yarn, in an intermediate position between said drawing roller and said combining roller of the combining means.

9. Machine as claimed in any one of claims 1, 2, 4 and 3, wherein disposed along the path of the textured covering yarn, between said drawing roller and said combining roller of the combining means, is an oven for heating and stabilizing the textured covering yarn.

10. A machine for texturing a covering yarn and interlacing the textured covering yarn with an elastomer yarn, the machine comprising:

a texturing zone through which the covering yarn advances;

a feed unit for the elastomer yarn, said feed unit including a delivery roller;

a combining device to combine the textured covering yarn with the elastomer yarn, said combining device including a combining roller to which the textured covering yarn and the elastomer yarn are fed;

a drawing roller for the textured covering yarn arranged along a path of said textured covering yarn, between said texturing zone and said combining roller of the combining device;

providing downstream of said combining roller an interlacing device to interlace the textured covering yarn and the elastomer yarn;

wherein a ratio between a speed of said drawing roller and a speed of rotation of said combining roller defines a stretch for the textured covering yarn and a ratio between a speed of said delivery roller and the speed of said combining roller defines a stretch for the elastomer yarn.

11. A machine for texturing a covering yarn and interlacing said textured covering yarn with an elastomer yarn, the machine comprising:

a texturing zone through which said covering yarn advances;

a feed unit for the elastomer yarn, said feed unit including a delivery roller;

a combining device to combine the textured covering yarn with the elastomer yarn, said combining device comprising a combining roller to which the textured covering yarn and the elastomer yarn are fed;

a drawing roller for the textured covering yarn arranged along a path of the textured covering yarn, between said texturing zone and said combining roller of the combining device;

providing downstream of said combining roller an interlacing device to interlace the textured covering yarn and said elastomer yarn;

wherein the ratio between a speed of rotation of said drawing roller and a speed of rotation of said combining roller defines a stretch for the textured covering yarn and a ratio between the speed of said delivery roller and said speed of said combining roller defines a stretch for the elastomer yarn.

12. A process for texturing a covering yarn and interlacing the textured covering yarn with an elastomer yarn, the process comprising the steps of:

texturing the covering yarn in a texturing zone;

moving the covering yarn from said texturing zone along a drawing roller downstream of said texturing zone;

moving the covering yarn from said drawing roller to a combining roller;

feeding the elastomer yarn from a delivery roller to said combining roller;

feeding the covering yarn and the elastomer yarn from said combining roller to an interlacing device, said interlacing device interlacing the covering yarn and the elastomer yarn;

forming a covering ratio between a speed of said drawing roller and a speed of said combining roller;

forming an elastic ratio between a speed of said delivery roller and said speed of said combining roller;

selectively changing said covering ratio and said elastic ratio independently of each other.

13. A process in accordance with claim 12, further comprising:

feeding the yarn from said interlacing device to a pick up roller;

forming a pickup a ratio between a speed of said combining roller and said pick up roller;

selectively changing said pick up ratio.

14. A process in accordance with claim 12, further comprising:

providing a counter pressure roller to each of said drawing roller and said combining roller, the covering yarn passing between said drawing roller and a respective said counterpressure roller, the covering yarn and the elastomer yarn passing between said combining roller and a respective said counterpressure roller.

15. A process in accordance with claim 12, wherein:

said changing of said covering ratio and said elastic ratio are performed to change characteristics of the combined covering yarn and elastomer yarn, and to reduce air consumption in said interlacing device.

* * * * *